US009272432B1

(12) United States Patent
Brand et al.

(10) Patent No.: US 9,272,432 B1
(45) Date of Patent: Mar. 1, 2016

(54) APPARATUS AND METHOD FOR CLAMPING AND CUTTING COMPRESSIBLE MATERIALS

(71) Applicants: Nathaniel Paul Brand, Coeur D'Alene, ID (US); Dalen Eugene Gunn, Coeur D'Alene, ID (US)

(72) Inventors: Nathaniel Paul Brand, Coeur D'Alene, ID (US); Dalen Eugene Gunn, Coeur D'Alene, ID (US)

( * ) Notice: Subject to any disclaimer, the term of this patent is extended or adjusted under 35 U.S.C. 154(b) by 197 days.

(21) Appl. No.: 13/915,348

(22) Filed: Jun. 11, 2013

(51) Int. Cl.

| | |
|---|---|
| ***B25B 5/06*** | (2006.01) |
| ***B26D 7/00*** | (2006.01) |
| *B26D 1/04* | (2006.01) |
| *B25B 5/08* | (2006.01) |

(52) U.S. Cl.
CPC ..... *B26D 7/0006* (2013.01); *B25B 5/06* (2013.01); *B25B 5/08* (2013.01); *B26D 1/045* (2013.01); *Y10T 83/7507* (2015.04)

(58) Field of Classification Search
CPC ..... B25B 1/2447; B25B 5/02; B25B 1/205; B25B 1/20; B25B 5/06; B25B 5/08; B42F 1/003; B26D 7/0006; B26D 1/045; Y10T 83/7507; Y10T 83/7513
USPC ..... 83/45–456, 614, 458–459; 269/287, 269/208, 166, 175, 43, 45, 71, 171, 225, 269/162, 254 CS; 248/316.5, 316.6, 316.8, 248/510
See application file for complete search history.

(56) References Cited

U.S. PATENT DOCUMENTS

| | | | | | |
|---|---|---|---|---|---|
| 2,779,364 | A | * | 1/1957 | Farmer | 100/233 |
| 3,086,510 | A | * | 4/1963 | Kranak | 125/35 |
| 3,354,769 | A | * | 11/1967 | Abramson et al. | 83/455 |
| 4,487,403 | A | * | 12/1984 | Burge | 269/2 |
| 5,069,097 | A | * | 12/1991 | Mori | 83/56 |

* cited by examiner

*Primary Examiner* — Ned Landrum
*Assistant Examiner* — Nhat Chieu Do

(57) ABSTRACT

An apparatus for cutting expanded fibrous and soft foam materials has a linear clamping feature with an integrated blade guide, suspended in a position to allow unobstructed travel of a cutting blade. Compression and cutting features are separated so that the cutting blade is protected from undue wear, cuts are consistent and uniform, and the apparatus is safe to use.

1 Claim, 5 Drawing Sheets

APPARATUS AND METHOD FOR CLAMPING AND CUTTING COMPRESSIBLE MATERIALS

RELATED APPLICATIONS

This application is related to provisional application 61/658,183, filed on Jun. 11, 2012, and being filed within one year claims international date priority thereof. The subject matter of application 61/658,183 is hereby incorporated herein by reference in its entirety.

BACKGROUND

The industrial field of this disclosure relates to cutting devices and cutting machines and specifically to such devices and machines applicable to severing materials that are compressible or fibrous.

Expanded fibrous materials are used in manufacturing and construction industries for insulating or sound dampening. These materials are not easily cut with standard techniques and equipment due to the inherent difficulty of simultaneously compressing and cutting dense and or resilient expanded materials. These materials are generally cut with a hand held knife guided by a straight-edge. The knife compresses the material against a supporting surface and the knife contacts this surface during the cutting operation. This causes the knife blade to become dull so that it must be sharpened or replaced frequently. Another problem is that manual cutting does not produce consistently clean cuts and is subject to inaccuracy and variations.

BRIEF SUMMARY AND OBJECTIVES

The presently described apparatus and its method of use is directed to overcoming the drawbacks found in the prior art. The present invention consists of a linear clamping device with an integrated blade guide, both suspended in a position to allow unobstructed travel of a cutting blade. By separating the compression and cutting steps and by ensuring that the cutting blade is protected from undue wear, the present invention teaches a way to cut the aforementioned material safely and without difficulty.

The advantages of the present invention include, without limitation, a means of compressing expanded fibrous materials or other compressible materials such that they may be cut more easily, while, in addition, providing a cutting guide for a knife or other bladed tool and suspending an active portion of the mechanism such that the blade is prevented from wearing on or running into other objects. Generally, the present apparatus is a clamping and cutting guide wherein upright members are secured to a base or stand such that a blade of a preferred size does not touch the base or stand. A moveable compressing member may be rotated into a raised position to allow a workpiece sheet material to be placed on a support bar. The compressing member may than be lowered onto the workpiece and latched which secures a knife guide in place. An adjustable and/or elastic means provides a desired amount of clamping force applicable to a range of material thicknesses and rigidities.

BRIEF DESCRIPTION OF DRAWINGS

Like reference symbols in the drawing figures indicate like elements.

DETAILED DESCRIPTION

Figure 1:
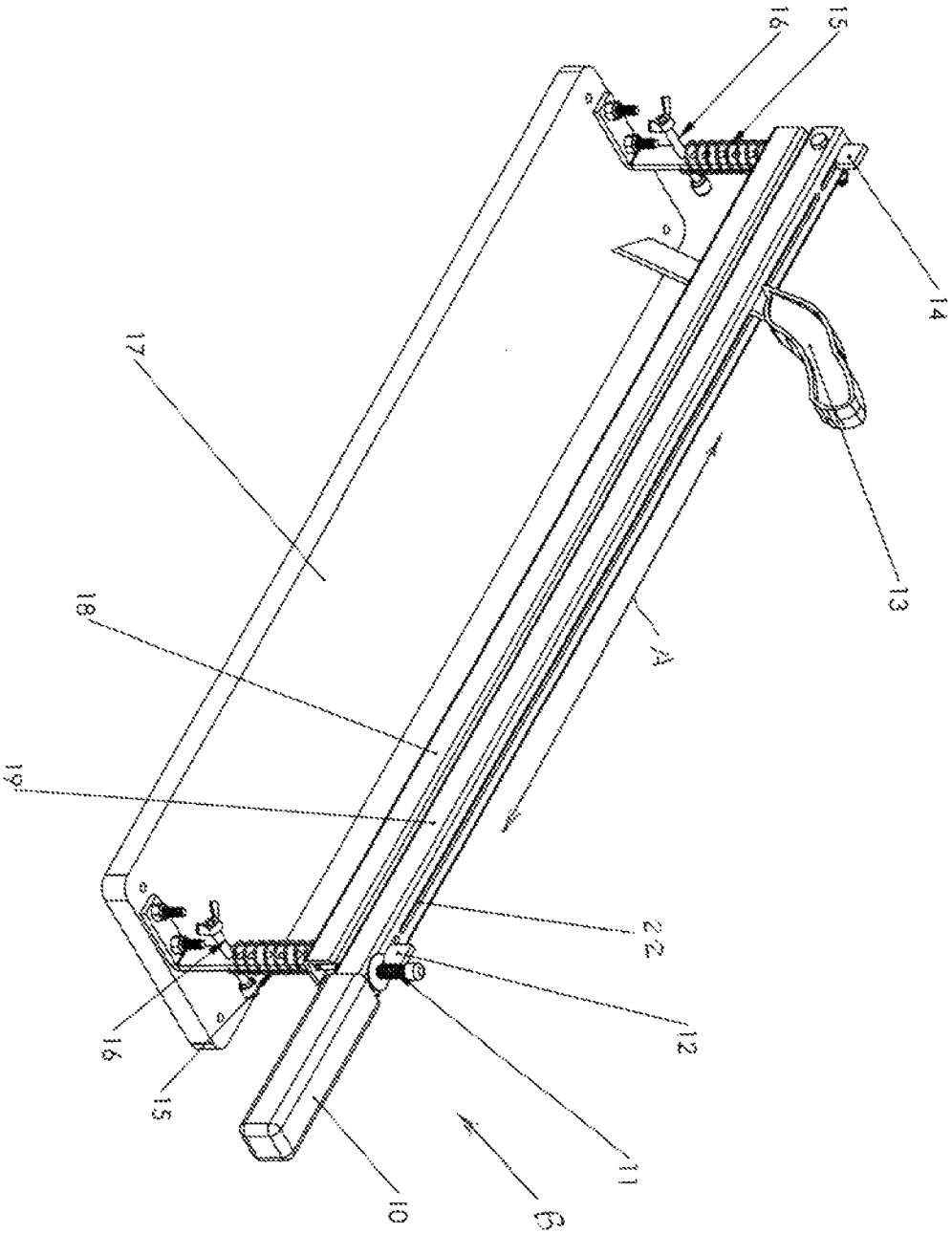
FIG. 1 is an example perspective view of a cutting apparatus according to a first embodiment, and shown with a clamp arm lowered, and a cutting blade inserted within cutting guides.
Figure 2:
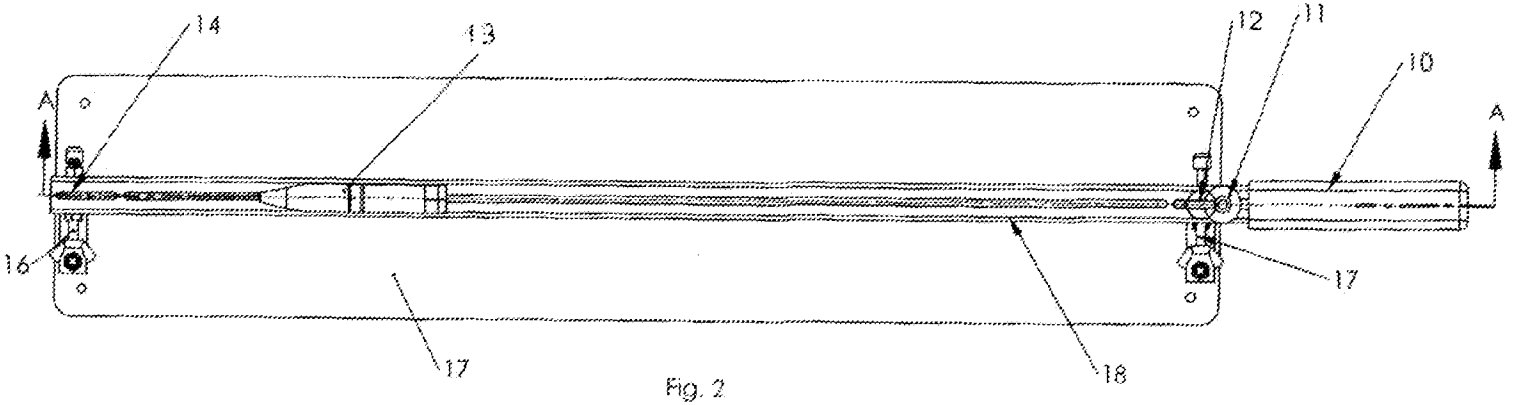
FIG. 2 is an example top plan view thereof.
Figure 3:
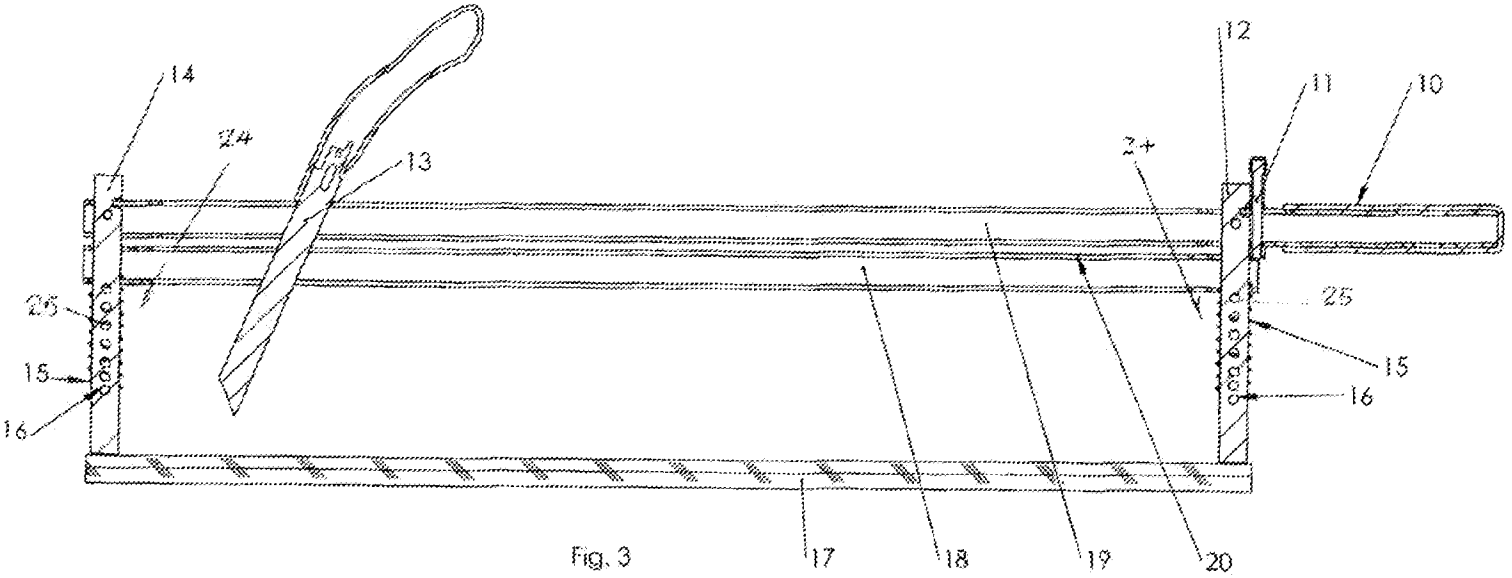
FIG. 3 is an example vertical section view according to cutting plane line A-A of FIG. 2 and showing a workpiece clamped between a support bar and the clamp arm.
Figure 4:
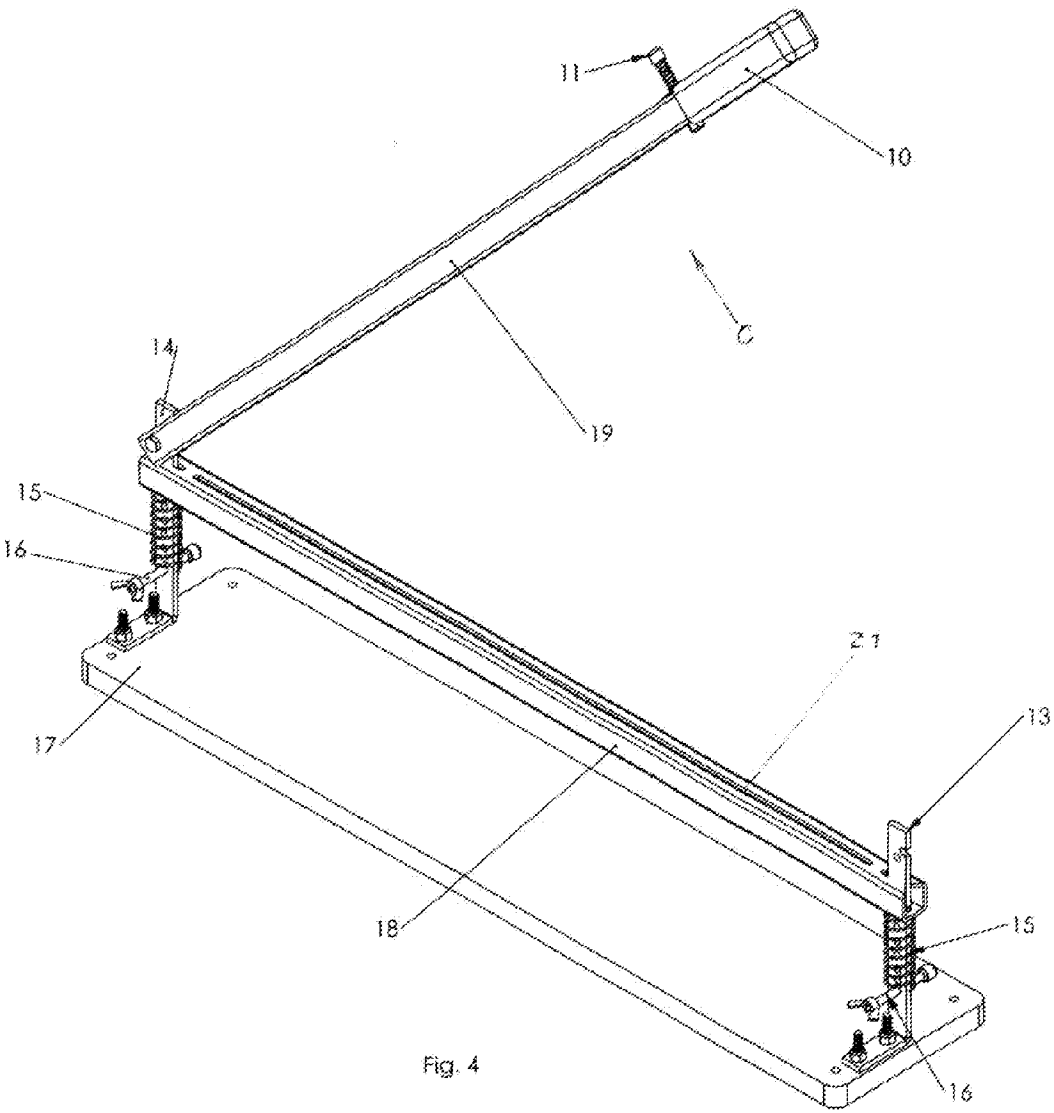
FIG. 4 is an example perspective view thereof shown with the clamp arm raised.

In a first embodiment, an apparatus for cutting a sheet goods workpiece 20, has a pair of spaced apart uprights 12 and 14 as shown in FIG. 1, the uprights extending in a common direction nominally referred to herein as "vertical" although an alternate direction may be used. The workpiece 20 as shown in FIGS. 3 and 4, may be any sheet goods and in particular may be an expanded fibrous material or compressible foam or other compressible material or other types. Such material may be any type of densely packed or resilient expanded materials. The uprights 12, 14 may be made of a rigid material such as steel configured as shown in FIGS. 1-4 or otherwise as suitable for cutting operations as described herein. The uprights 12, 14, may be rigidly secured to a base 17 in fixed mutual positions which define a first direction between them (see arrow "A"). The base 17 may be a wooden platform, or any other support structure made of any rigid material suitable for the intended purpose as described herein.

A support bar 18 may be engaged with and extensive between the uprights 12 and 14. Support bar 18 may be fabricated from square tube stock as shown in FIGS. 1-4 and may be slotted, notched or pierced at its opposing ends as shown in FIG. 4 for engagement with uprights 12 and 14 in a manner allowing support bar 18 to move vertically (float) on uprights 12 and 14 while maintaining engagement and a horizontal attitude. Support bar 18 may have a first elongated slot 21 (FIG. 4) therein lying in the first direction "A".

A clamp arm 19 may have a second elongated slot 22 therein, the clamp arm 19 pivotally engaged, using a pivot pin or other pivotal means, with one of the pair of uprights. In this embodiment, clamp arm 19 is rotatable about upright 12; and is therefore movable between a first position "B" placing clamp arm 19 in parallel with support bar 18 as shown in FIG. 1, and a second position "C" placing clamp arm 19 angularly spaced apart from support bar 18 as shown in FIG. 4. When clamp arm 19 is positioned in first position "B" it may be latched in place by any common latching device 12 and therefore take a fixed rigid horizontal position. A means for setting a uniform space between support bar 18 and clamp arm 19 when clamp arm 19 is in the first position "B" may include a pin-in-hole arrangement 24 as shown in FIG. 3. The pin-in-hole arrangement may include plural holes 25 aligned in the vertical within each of the uprights 12 and 14 and, further, an adjustment pin 16 may be engaged within a selected one of said plural holes 25 in each of the uprights. A spring 15 may be positioned between the support bar 18 and the adjustment pin 16 in each of the uprights, and such a spring 15 may be a coil spring placed about each of the uprights 12, 14.

Figure 5:
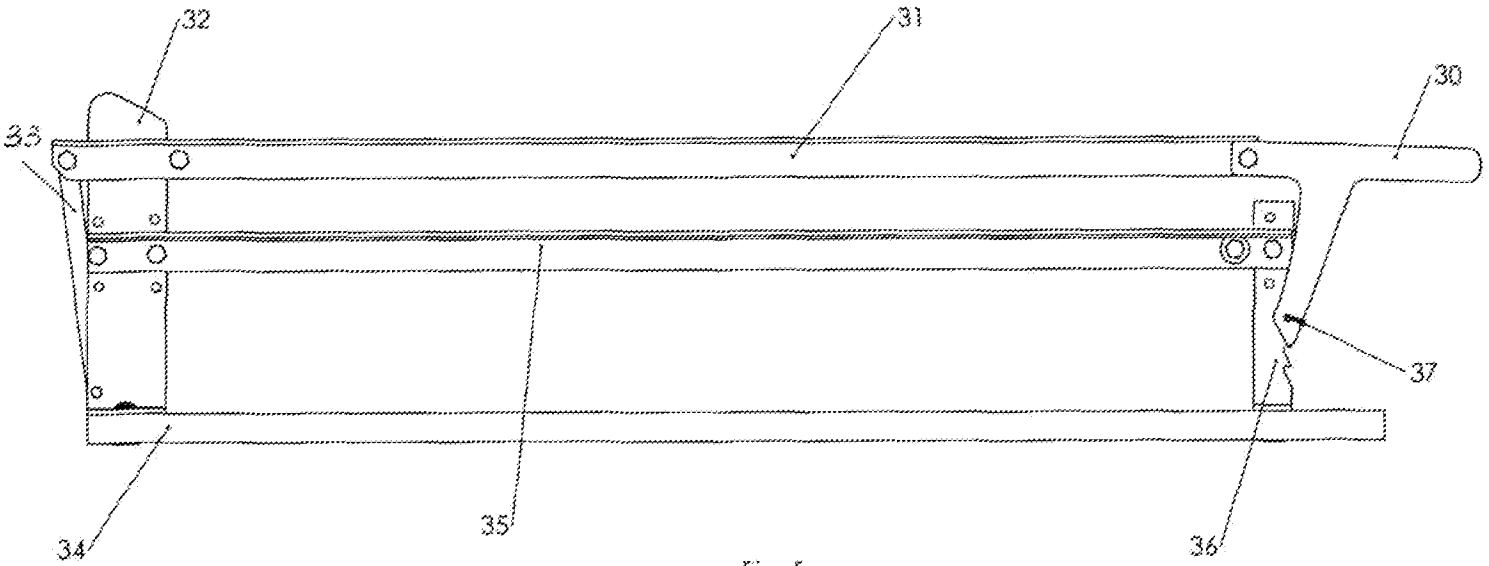
FIG. 5 is an example side elevation view of a second embodiment of the apparatus.
Figure 6:
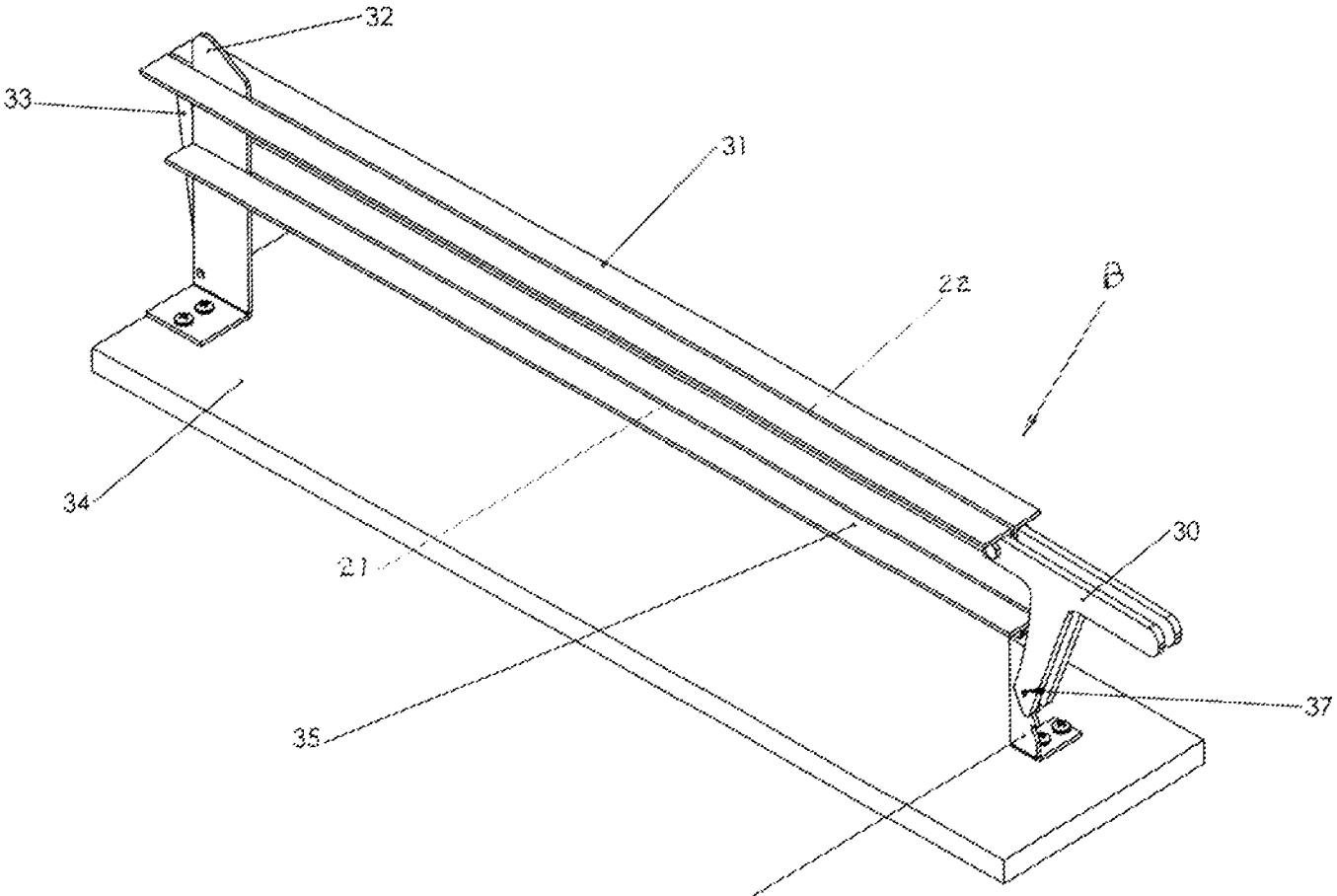
FIG. 6 is an example perspective view thereof.

In a second embodiment, the apparatus for cutting a sheet goods workpiece 20, has a pair of spaced apart uprights 32 and 36 as shown in FIG. 5, the uprights extending in a common direction nominally referred to herein as "vertical" although an alternate direction may be used. The uprights 32, 36 may be made of a rigid material such as steel configured as shown in FIG. 5 or otherwise as suitable for cutting operations as described herein. The uprights 32, 36, may be rigidly secured to a base 34 in fixed mutual positions which define a first direction (see arrow "A"). The base 34 may be a wooden platform, or any other support structure made of any rigid material suitable for the intended purpose as described herein.

A support bar 35 may be engaged with and extensive between the uprights 32 and 36. Bar 35 may be fabricated from extruded angle stock of a rigid and strong metal with two separate pieces placed in mirror image positions and fixed by common hardware to uprights 32 and 36 as shown in FIG. 5. Support bar 35, although being mounted in a rigid and fixed position on uprights 32 and 36 may be positionally adjusted by changing its mounted position vertically on the uprights within alternate hole sets as shown in FIG. 5. Support bar 35 is not able to move dynamically as with support bar 18 described in the first embodiment. Support bar 35 may have a first elongated slot 21 therein lying in the first direction "A", said slot 21 may be the result of a longitudinal separation between the L-rods as shown.

A clamp arm 31 may be constructed in the same manner as with support bar 35 thereby having a second elongated slot 22 therein, the clamp arm 31 may be pivotally engaged, using a compliant member 33 such as a tension spring, an elastomeric strip, a pneumatic cylinder or similar device engaged with upright 32; and is therefore rotatable between a first position "B" placing clamp arm 31 in parallel with the support bar 35 as shown in FIG. 5, and a second position placing clamp arm 31 angularly spaced apart from support bar 35 in a similar arrangement as shown in FIG. 4. Upright 32 may extend through slot 22 thereby assuring that clamp arm 31 rotates in a vertical plane. When clamp arm 31 is positioned in first position "B" it may be latched in place by any common latching device but more specifically by engagement between a latching pin 37 carried on a downwardly extending portion 38 of clamp arm 31 into any one of a set of vertically aligned notches 39 in upright 36 as shown in FIG. 5. Therefore, clamp arm 31 is able to be fixed into a rigid, approximately horizontal attitude.

In both of the above described embodiments, the support bar 18 or 35 may be set at a selected position on the uprights 12, 14 and 32, 36 respectively relative to base 17 or 34. In the first embodiment it is clear that support bar 18 may be more easily adjusted as to its height above the base 17 and its space apart from clamp arm 19. Also, in the first embodiment, support bar 18 may be spring mounted so that with workpiece 20 lying between support bar 18 and clamp arm 19 a clamping force is applied to workpiece 20 and this force is directly related to the space between support bar 18 and clamp arm 19, as well as the resistance against being compressed of the workpiece 20 which is a characteristic that varies with the type and thickness of workpiece 20. With respect to the second embodiment, once set, the support bar 35 is not movable, while clamp arm 31 may be secured in a variable clamping position which changes the space between bar 35 and arm 31 and thus the clamping force on the workpiece 20.

Embodiments of the subject apparatus and method have been described herein. Nevertheless, it will be understood that modifications may be made without departing from the spirit and understanding of this disclosure. Accordingly, other embodiments and approaches are within the scope of the following claims.

Clamp arm 19 may have a handle 10 and a clamping screw 11. Knife 13 is shown in FIG. 1. Handle 30 is shown in FIG. 5

What is claimed is:

1. An apparatus for cutting a workpiece, the apparatus comprising: a clamp arm pivotally engaged with, and rotatable about one of a pair of spaced apart uprights;

a support bar positioned between said uprights and engaged therewith by slots in the support bar, wherein said support bar is free to move along said uprights;

said clamp arm movable between a first position parallel with said support bar and a second position angularly spaced apart from said support bar;

each of said uprights having plural holes therein and an adjustment pin engaged within a selected one of said plural holes;

each of said uprights having a spring positioned between said support bar and said adjustment pin wherein positions of said adjustment pins determines compression of said springs and clamping force of a workpiece between said clamp arm and said support bar; and a knife manually movable between the uprights within an additional slot in said support bar when the clamp arm is in the first position for cutting the workpiece when the workpiece is clamped between the support bar and the clamp arm.

* * * * *